US008648795B2

(12) United States Patent
Nagano

(10) Patent No.: US 8,648,795 B2
(45) Date of Patent: Feb. 11, 2014

(54) DISPLAY SHEET, DISPLAY DEVICE, ELECTRONIC DEVICE, AND DISPLAY SHEET DRIVING METHOD

(75) Inventor: Daisuke Nagano, Matsumoto (JP)

(73) Assignee: Seiko Epson Corporation (JP)

( * ) Notice: Subject to any disclaimer, the term of this patent is extended or adjusted under 35 U.S.C. 154(b) by 326 days.

(21) Appl. No.: 13/112,384

(22) Filed: May 20, 2011

(65) Prior Publication Data

US 2011/0310130 A1 Dec. 22, 2011

(30) Foreign Application Priority Data

Jun. 22, 2010 (JP) ..... 2010-141820

(51) Int. Cl.
*G09G 3/34* (2006.01)

(52) U.S. Cl.
USPC ..... 345/107

(58) Field of Classification Search
None
See application file for complete search history.

(56) References Cited

U.S. PATENT DOCUMENTS

| | | | | |
|---|---|---|---|---|
| 6,525,866 | B1 * | 2/2003 | Lin et al. | 359/296 |
| 7,319,554 | B1 * | 1/2008 | Abe et al. | 359/296 |
| 7,342,556 | B2 * | 3/2008 | Oue et al. | 345/33 |
| 2005/0280626 | A1 * | 12/2005 | Amundson et al. | 345/107 |
| 2008/0013155 | A1 * | 1/2008 | Honeyman et al. | 359/296 |
| 2010/0259813 | A1 | 10/2010 | Kawase et al. | |

FOREIGN PATENT DOCUMENTS

JP 2009-145873 7/2009

* cited by examiner

*Primary Examiner* — Christopher R Lamb
(74) *Attorney, Agent, or Firm* — Harness, Dickey & Pierce, P.L.C.

(57) ABSTRACT

A method for driving a display sheet having a display layer having storage portions containing first particles and second particles includes a reset period having a first period in which the second particles are moved to one surface and also the first particles are moved to the other surface and a second period, after the first period, in which the first particles are moved to the one surface and also the second particles are moved to the other surface.

10 Claims, 10 Drawing Sheets

DISPLAY SHEET, DISPLAY DEVICE, ELECTRONIC DEVICE, AND DISPLAY SHEET DRIVING METHOD

BACKGROUND

1. Technical Field

The present invention relates a display sheet, a display device, an electronic device, and a display sheet driving method.

2. Related Art

For example, an electrophoretic display utilizing electrophoresis of particles is known as one constituting an image display portion of electronic paper (e.g., Japanese Unexamined Patent Application Publication No. 2009-145873). The electrophoretic display has excellent flexibility and power saving ability and is particularly suitable as the image display portion of electronic paper.

Japanese Unexamined Patent Application Publication No. 2009-145873 discloses a display device having a first electrode (two or more pixel electrodes) and a second electrode (common electrode) that are disposed facing each other and two or more microcapsules provided therebetween. In each microcapsule, a dispersion liquid is enclosed in which two or more positively charged black particles (second particles) and two or more negatively charged white particles (first particles) are dispersed in a liquid phase dispersion medium. The display device of Japanese Unexamined Patent Application Publication No. 2009-145873 is structured so that a desired image is displayed on a display surface by causing a desired electric field to act on each microcapsule, and then selecting for every microcapsule either one state of a black color display state in which the black particles are unevenly present at the display surface side (second electrode side) and a white display state in which the white particles are unevenly present at the display surface side.

However, according to the display device of Japanese Unexamined Patent Application Publication No. 2009-145873, when, in order to switch an image displayed on the display surface from a first image to a second image, an electric field corresponding to the second image is caused to act on each microcapsule, afterimages resulting from the first image are displayed on the display surface with the second image.

It is considered that such a problem arises for the following reasons. For example, the description is given to one microcapsule. When switching the display state from the black display state to the white display state, the black particles are moved to the first electrode side from the second electrode side and the white particles are moved to the second electrode side from the first electrode side. In this case, since the white particles are in a dispersion state in the liquid phase dispersion medium, the white particles reach the second electrode side in a short period of time. Then, the white particles move to the second electrode while the black particles are still moving near the second electrode, resulting in the fact that some black particles are surrounded by two or more white particles, and then the black particles stay at the second electrode side as they are. Thus, particles that need to move to the first electrode side under normal circumstances stay at the second electrode side without moving, and the particles affect the display color, which is considered to be a cause of the generation of afterimages described above.

SUMMARY

An advantage of some aspects of the invention is to provide a display sheet capable of reducing the generation of afterimages, a display device, an electronic device, and a display sheet driving method.

Such a purpose is achieved by the invention described below.

A display sheet of the invention has a display layer having two or more storage portions storing two or more positively or negatively charged first particles and two or more second particles that are charged with polarity opposite to that of the first particles and have color whose light reflectance is lower than that of the first particles, in which, by causing an electric field to act on each of the two or more storage portions so that each of the two or more storage portions achieves a first display state in which the second particles are unevenly present at one surface of the display layer and the first particles are dispersed in the storage portion or a second display state in which the second particles are unevenly present at the other surface of the display layer and the first particles are dispersed in the storage portion, the display sheet displays a desired image on the display surface provided at the one surface of the display layer; in which, when switching a first image displayed on the display surface to a second image different from the first image, a reset period for causing a resetting electric field for achieving the second display state to act at least on the storage portions in the first display state among the two or more storage portions is provided prior to causing an electric field for displaying the second image to act on the two or more storage portions; and the reset period has a first period in which the second particles are moved to the one surface and also the first particles are moved to the other surface and a second period, after the first period, in which the first particles are moved to the one surface and also the second particles are moved to the other surface.

Thus, a display sheet capable of reducing the generation of afterimages can be provided.

A display sheet of the invention has a display layer having two or more storage portions storing two or more non-charged first particles and two or more positively or negatively charged second particles that have color whose light reflectance is lower than that of the first particles, in which, by causing an electric field to act on each of the two or more storage portions so that each of the two or more storage portions achieves a first display state in which the second particles are unevenly present at one surface of the display layer and the first particles are dispersed in the storage portion or a second display state in which the second particles are unevenly present at the other surface of the display layer and the first particles are dispersed in the storage portion, the display sheet displays a desired image on the display surface provided at the one surface of the display layer; in which, when switching a first image displayed on the display surface to a second image different from the first image, a reset period for causing a resetting electric field for achieving the second display state to act at least on the storage portions in the first display state among the two or more storage portions is provided prior to causing an electric field for displaying the second image to act on the two or more storage portions; and the reset period has a first period in which the second particles are moved to the one surface and also the first particles are moved to the other surface and a second period, after the first period, in which the first particles are moved to the one surface and also the second particles are moved to the other surface.

Thus, a display sheet capable of reducing the generation of afterimages can be provided.

In the display sheet of the invention, the resetting electric field is preferably caused to act only on the storage portions in the first display state.

Thus, an unnecessary electric field can be prevented from acting on the storage portions that are in the white display state from the beginning. Therefore, the reliability of the device increases and power saving can be achieved.

It is preferable in the display sheet of the invention that the reset period have a third period, in which no electric field is generated, between the first period and the second period and the period of the third period be within 2 seconds.

Thus, the movement of the first particles and the second particles can be made to stop once. Therefore, these particles can be smoothly moved in the second period. Moreover, the first particles attracted to the other side of the display surface by the first period can prevented from being re-dispersed (returning to the original state).

In the display sheet of the invention, the first period is preferably 0.2 second or more.

Thus, the first particles can be sufficiently moved to the other surface of the display surface.

In the display sheet of the invention, the second period is preferably 0.2 second or more.

Thus, the first particles can be more certainly moved to one surface of the display surface and the second particles can be moved to the other surface of the display surface.

In the display sheet of the invention, the strength of the resetting electric field in the first period is preferably equal to the strength of the electric field that is caused to act on the storage portions for achieving the first display state in the storage portions.

This simplifies the device structure (circuit structure).

In the display sheet of the invention, the strength of the electric field in the second period is preferably equal to the strength of the electric field that is caused to act on the storage portions for achieving the second display state in the storage portions.

This simplifies the device structure (circuit structure).

A display device of the invention has the display sheet of the invention.

Thus, a display device capable of reducing the generation of afterimages can be provided.

An electronic device of the invention has the display device of the invention.

Thus, an electronic device capable of reducing the generation of afterimages can be provided.

A display sheet driving method of the invention is a method for driving a display sheet having a display layer having two or more storage portions storing two or more positively or negatively charged first particles and two or more second particles that are charged with polarity opposite to that of the first particles and have color whose light reflectance is lower than that of the first particles, in which, by causing an electric field to act on the two or more storage portions so that each of the two or more storage portions achieves a first display state in which the second particles are unevenly present at one surface of the display layer and the first particles are dispersed in the storage portion or a second display state in which the second particles are unevenly present at the other surface of the display layer and the first particles are dispersed in the storage portion, the display sheet displays a desired image on the display surface provided at the one surface of the display layer; in which the method includes driving the display sheet in such a manner as to provide, when switching a first image displayed on the display surface to a second image different from the first image, a reset period for causing a resetting electric field for achieving the second display state to act at least on the storage portions in the first display state among the two or more storage portions prior to causing an electric field for displaying the second image to act on the two or more storage portions; and the reset period has a first period in which the second particles are moved to the one surface and also the first particles are moved to the other surface and a second period, after the first period, in which the first particles are moved to the one surface and also the second particles are moved to the other surface.

According to such a driving method, the generation of afterimages can be reduced.

A display sheet driving method of the invention is a method for driving a display sheet having a display layer having two or more storage portions storing two or more non-charged first particles and two or more positively or negatively charged second particles that have color whose light reflectance is lower than that of the first particles, in which, by causing an electric field to act on each of the two or more storage portions so that each of the two or more storage portions achieves a first display state in which the second particles are unevenly present at one surface of the display layer and the first particles are dispersed in the storage portion or a second display state in which the second particles are unevenly present at the other surface of the display layer and the first particles are dispersed in the storage portion, the display sheet displays a desired image on the display surface provided at the one surface of the display layer; in which, the method includes driving in such a manner as to provide, when switching a first image displayed on the display surface to a second image different from the first image, a reset period for causing a resetting electric field for achieving the second display state to act at least on the storage portions in the first display state among the two or more storage portions prior to causing an electric field for displaying the second image to act on the two or more storage portions; and the reset period has a first period in which the second particles are moved to the one surface and also the first particles are moved to the other surface and a second period, after the first period, in which the first particles are moved to the one surface and also the second particles are moved to the other surface.

According to such a driving method, the generation of afterimages can be reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a display sheet, a display device, and an electronic device of the invention will be described in detail with reference to preferable embodiments illustrated in the accompanied drawings.

1. Display Device

First, a display device (display device of the invention) in which a display sheet of the invention is placed will be described.

First Embodiment

Figure 1:
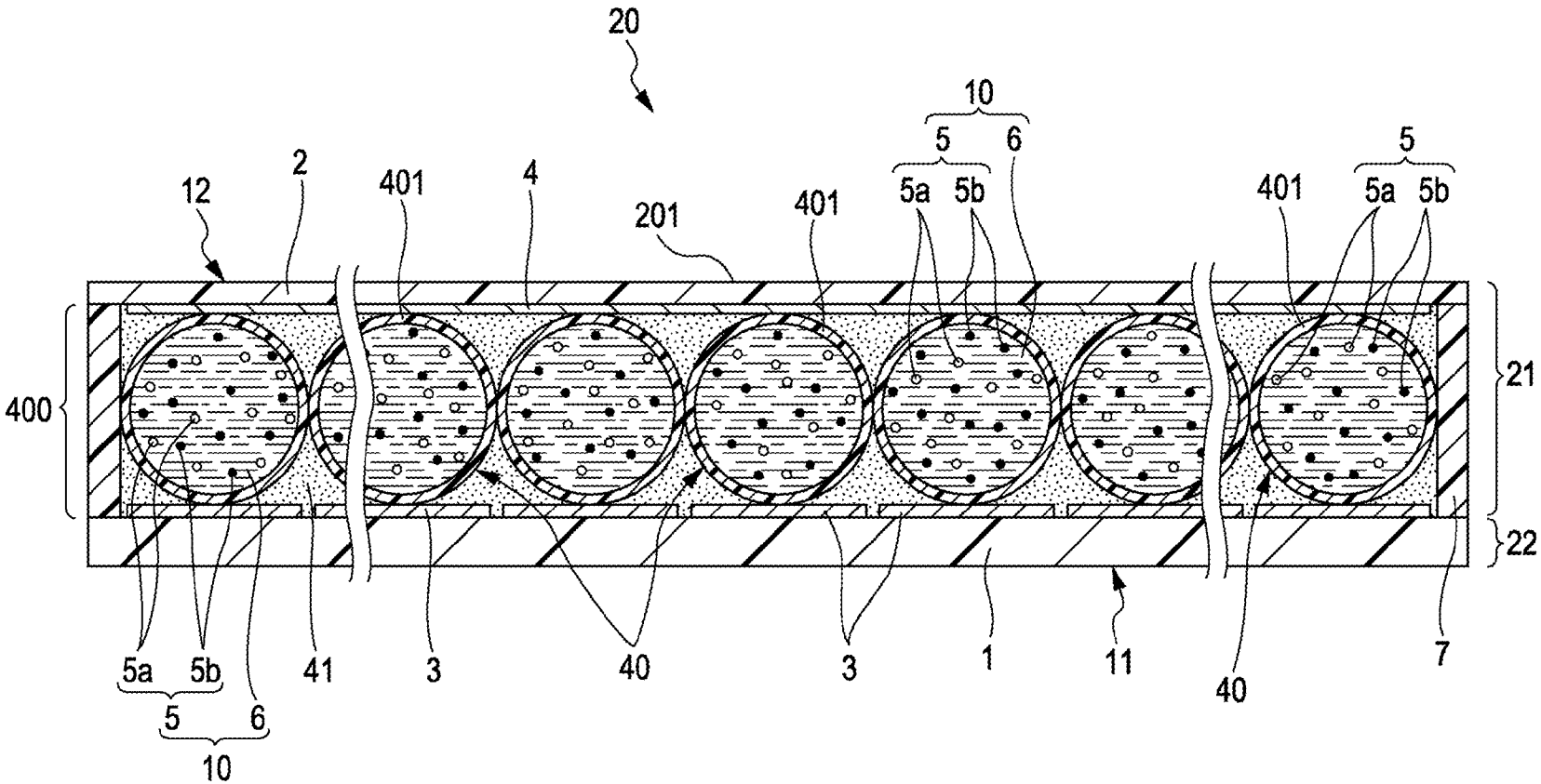
FIG. 1 is a longitudinal cross sectional view schematically illustrating a first embodiment of a display device of the invention.
Figure 2B:
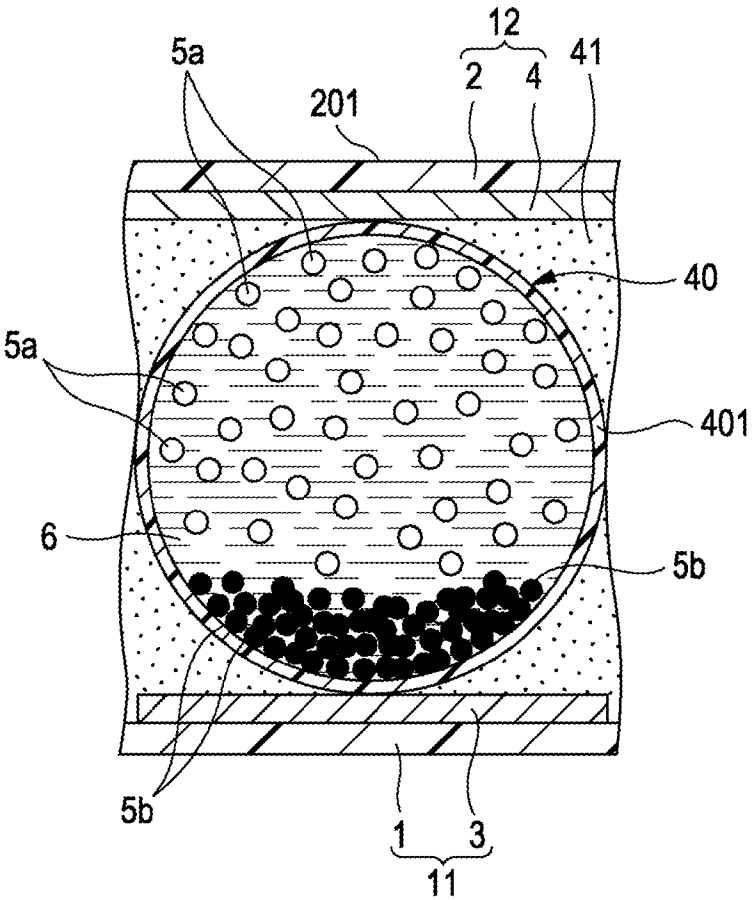
FIGS. 2A and 2B are cross sectional views for illustrating the operation of the display device illustrated in FIG. 1.
Figure 3B:
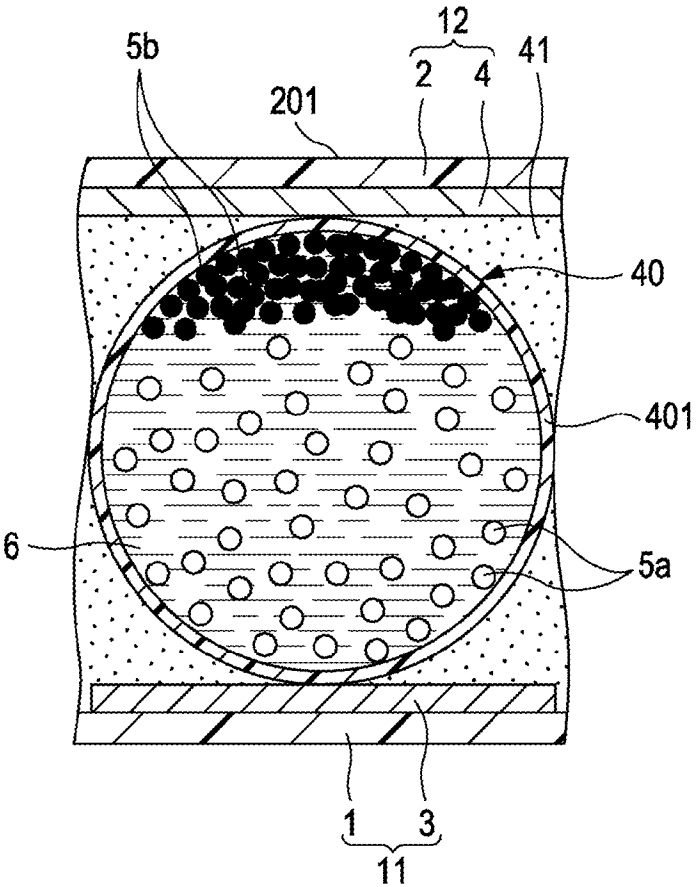
FIGS. 3A and 3B are cross sectional views for illustrating the operation of the display device illustrated in FIG. 1.
Figure 4A:
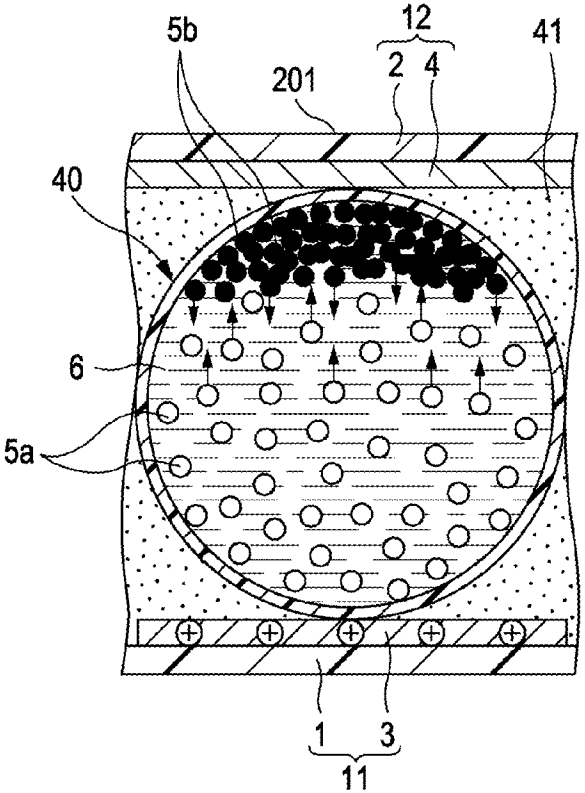
FIGS. 4A, 4B, and 4C are cross sectional views for illustrating former problems using the display device illustrated in FIG. 1.
Figure 4B:
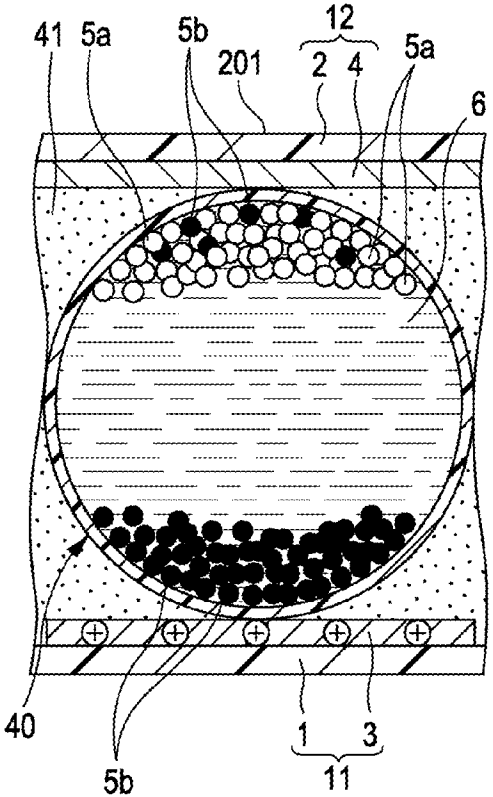
Figure 4C:
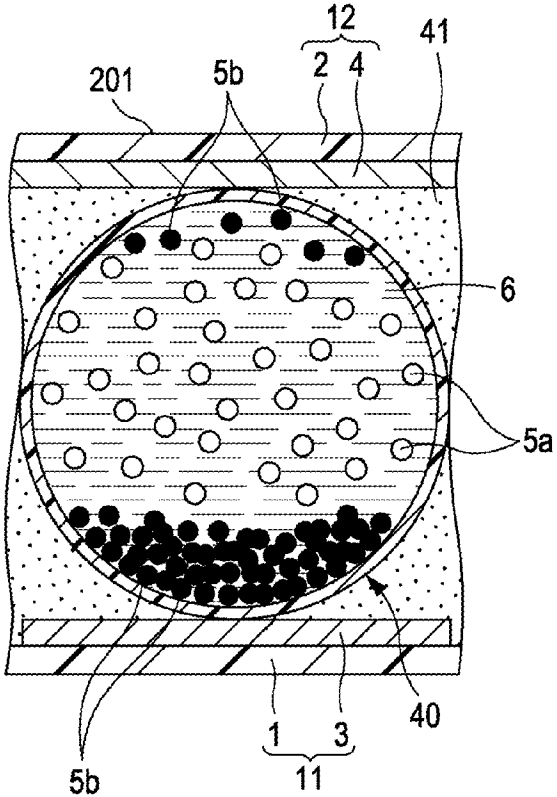
Figure 5A:
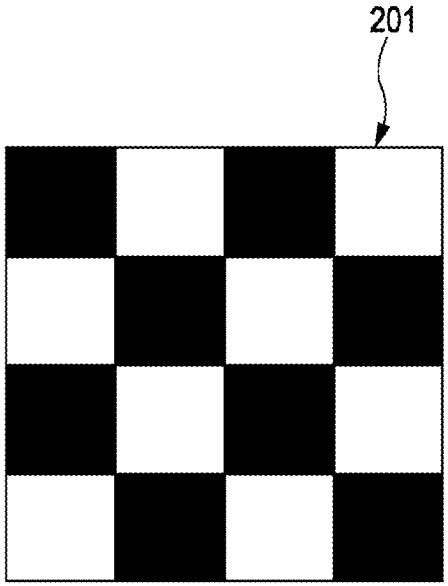
FIGS. 5A, 5B, and 5C are plan views for illustrating former problems using the display device illustrated in FIG. 1.
Figure 5B:
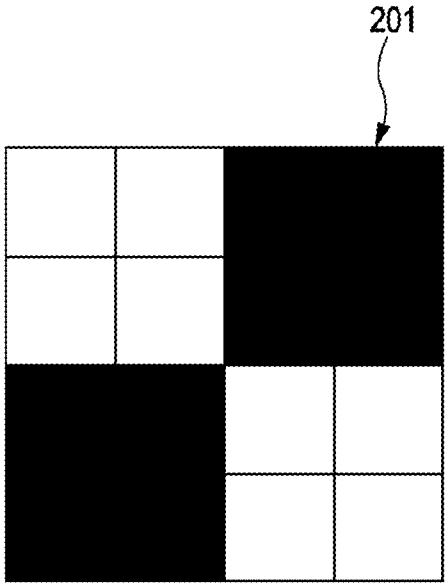
Figure 5C:
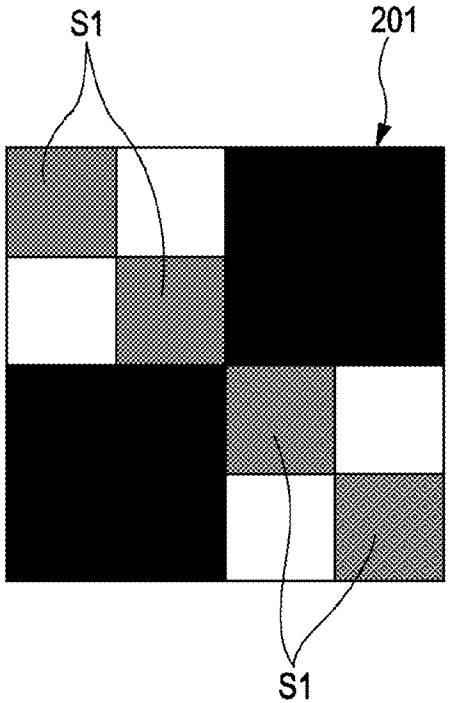
Figure 6:
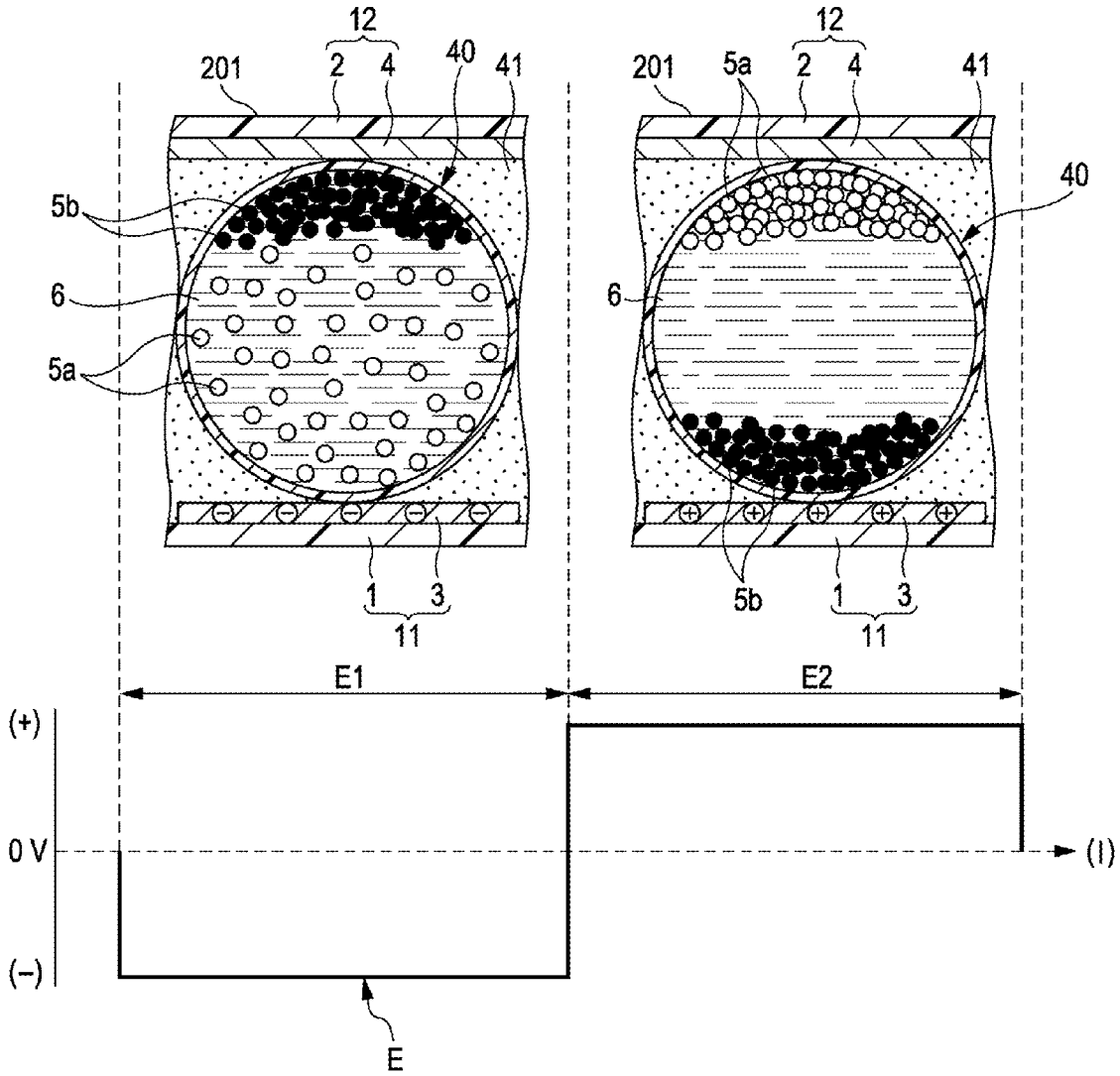
FIG. 6 is a cross sectional view for illustrating the operation of the display device illustrated in FIG. 1 when a resetting electric field is applied.
Figure 7:
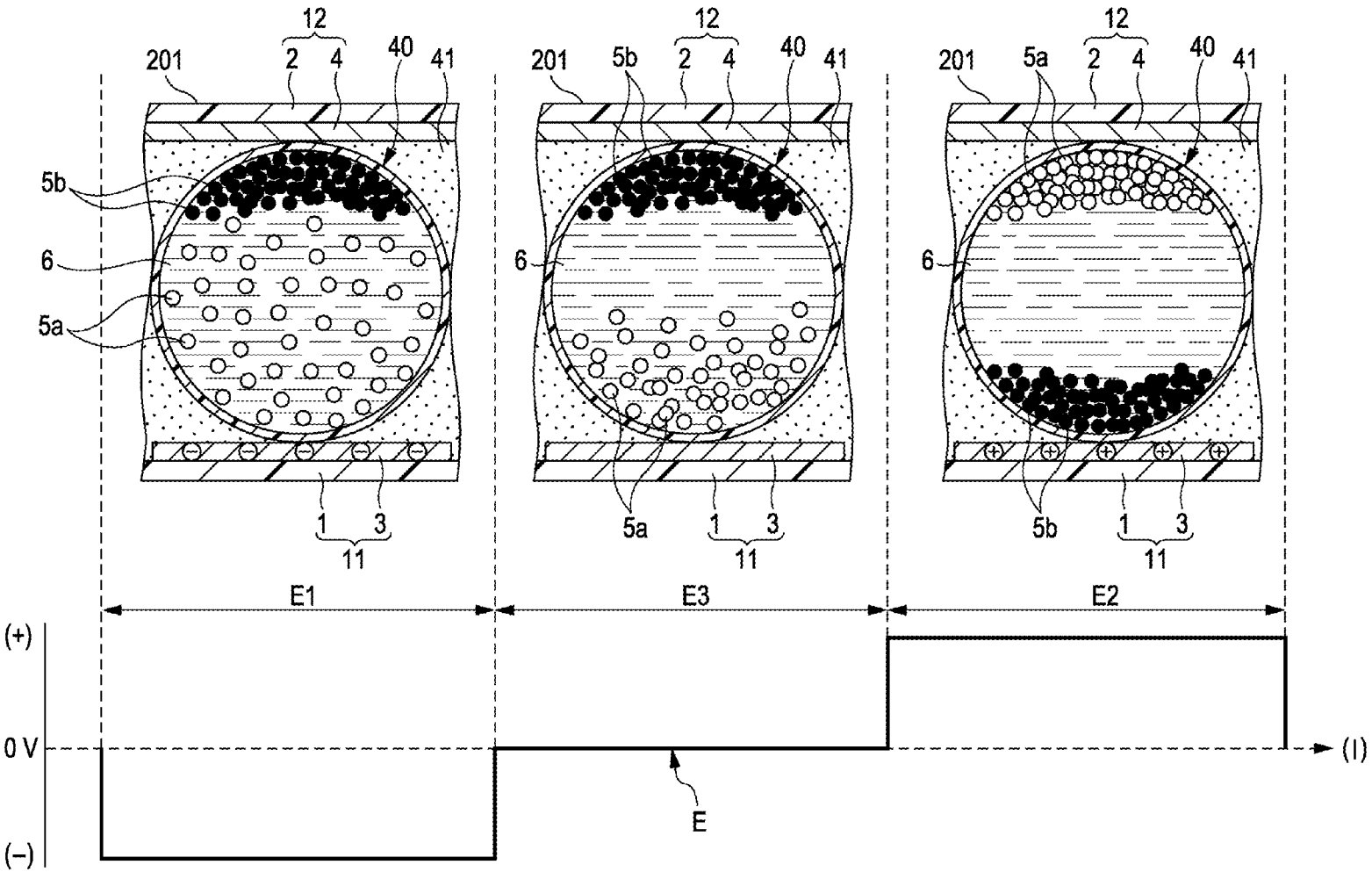
FIG. 7 is a view illustrating a modification of the resetting electric field illustrated in FIG. 6.

FIG. 1 is a longitudinal cross sectional view schematically illustrating a first embodiment of the display device of the invention. FIGS. 2A and 2B and FIGS. 3A and 3B are cross sectional views for illustrating the operation of the display device illustrated in FIG. 1. FIGS. 4A, 4B, and 4C are cross sectional views for illustrating former problems using the display device illustrated in FIG. 1. FIGS. 5A, 5B, and 5C are plan views for illustrating former problems using the display device illustrated in FIG. 1. FIG. 6 is a cross sectional view for illustrating the operation of the display device illustrated in FIG. 1 when a resetting electric field is applied. FIG. 7 is a view illustrating a modification of the resetting electric field illustrated in FIG. 6. The following description will be given while defining the upper side in FIGS. 1 to 7 as the "top" and defining the lower side thereof as the "bottom" for convenience of the description.

A display device (electrophoretic display device) 20 illustrated in FIG. 1 has a display sheet (front plane) 21 and a circuit board (back plane) 22.

The display sheet 21 has a substrate (base material) 12 having a plate-like base 2 and a second electrode 4 provided on the lower surface of the base 2, a display layer 400 that is provided on the substrate 12 and is constituted by microcapsules 40 and a binder 41, and a sealing portion 7 that seals the space in an airtight manner between the substrate 12 and the circuit board 22.

In contrast, the circuit board 22 has a counter substrate 11 having a plate-like base 1 and two or more first electrodes 3 provided on the upper surface of the base 1 and a circuit (not illustrated) containing, for example, a switching element, such as TFT, provided on the counter substrate 11 (base 1).

Hereinafter, the structure of each portion will be described one by one.

The base 1 and the base 2 each are constituted by sheet-like (plate-like) members and have a function of supporting and protecting each component disposed between them. Each of the bases 1 and 2 may be either a flexible one or a hard one and is preferably a flexible one. By the use of the bases 1 and 2 having flexibility, the display device 20 having flexibility, i.e., the display device 20 that is useful for structuring electronic paper, for example, can be obtained.

When a flexible one is used for each of the bases (base material layer) 1 and 2, mentioned as materials constituting the same are, for example, polyester, such as PET (polyethylene terephthalate) and PEN (polyethylenenaphthalate), polyolefin, such as polyethylene, and various thermoplastic elastomers, such as modified polyolefin, polyamide, thermoplastic polyimide, polyether, polyetheretherketone, polyurethane based elastomers, and chlorinated polyethylene based elastomers or copolymers, blends, polymer alloys, and the like containing the same as the main ingredients. These materials can be used singly or as a mixture of two or more kinds thereof.

The average thickness of the above-described bases 1 and 2 each is determined as appropriate depending on the constituent materials, intended use, and the like and is not particularly limited. When a flexible one is used for the bases 1 and 2, the average thickness is preferably about 20 μm or more and about 500 μm or lower and more preferably about 25 μm or more and about 250 μm or lower. Thus, a reduction in the size (particularly a reduction in the thickness) of the display device 20 can be achieved while coordinating the softness and the strength of the display device 20.

On the surfaces at the side of the microcapsules 40 of the bases 1 and 2, i.e., the upper surface of the base 1 and the lower surface of the base 2, layer-like (film-like) first electrodes 3 and a second electrode 4 are provided, respectively.

When a voltage is applied between the first electrodes 3 and the second electrode 4, an electric field is generated therebetween. The electric field acts on electrophoretic particles 5 described later in the microcapsules 40. In this embodiment, the second electrode 4 is used as a common electrode and the first electrodes 3 are used as individual electrodes (pixel electrodes connected to a switching element) divided in the shape of a matrix (the shape of lines) and a portion where the second electrode 4 and one first electrode 3 are overlapped constitutes one pixel. The second electrode 4 may also be divided into two or more pieces in the same manner as the first electrode 3. Moreover, an aspect may be acceptable in which the first electrode 3 is divided in the shape of a stripe, the second electrode is similarly divided in the shape of a stripe, and the first and second electrodes are disposed in such a manner as to cross each other.

In this embodiment, a structure is described in which one microcapsule 40 is contained in one pixel as illustrated in FIG. 1. However, the structure is not limited thereto and may be a structure in which two or more (e.g., about ten) microcapsule 40 are contained in one pixel, for example.

The constituent materials of each of the electrodes 3 and 4 are not particularly limited insofar as the materials each substantially have conductivity. For example, mentioned are various conductive materials, such as: metal materials, such as gold, silver, copper, aluminum, or an alloy containing the same, carbon materials, such as carbon black, electronically conductive polymer materials, such as polyacetylene, polyfluorene, or a derivative thereof, ionically conductive polymer materials in which ionic substances, such as NaCl and $Cu(CF_3SO_3)_2$, are dispersed in matrix resin, such as polyvinyl alcohol and polycarbonate, and conductive oxide materials, such as indium oxide (IO), indium tin oxide (ITO), and fluoride doped tin oxide (FTO). The materials can be used singly or in combination of two or more kinds thereof.

The average thickness of such electrodes 3 and 4 each is determined as appropriate depending on the constituent materials, intended use, and the like and is not particularly limited. The average thickness is preferably about 0.01 μm or more and about 10 μm or lower and more preferably about 0.02 μm or more and about 5 μm or lower.

Herein, the base and the electrode (the base 2 and the second electrode 4 in this embodiment) each disposed at a display surface 201 side among each of the bases 1 and 2 and each of the electrodes 3 and 4 have an optical transparency, i.e., substantially transparent (colorless and transparent, colored and transparent, or semitransparent). Thus, the state of the electrophoretic particles 5 in an electrophoretic dispersion liquid 10 described later, i.e., information (image) displayed on the display surface 201 of the display device 20, can be easily visually recognized.

In the display sheet 21, the display layer 400 is provided contacting the lower surface of the second electrode 4. The display layer 400 has a structure in which the two or more microcapsules (storage portions) 40 in which the electrophoretic dispersion liquid 10 is enclosed in a capsule main body 401 are held by the binder 41.

As illustrated in FIG. 1, the microcapsules 40 are disposed in parallel in a matrix with a single layer (i.e., individually disposed without overlapping in the thickness direction) and are disposed over the entire thickness direction of the display layer 400 between the counter substrate 11 and the substrate 12. More specifically, the microcapsules 40 are arranged in the display layer 400 in such a manner that the microcapsules 40 adjacent to each other in the plane direction contact each other and are not laid on top each other in the thickness direction. Moreover, the microcapsules 40 have an almost spherical shape (a globular shape) without being vertically compressed.

Herein, when the display device 20 is placed in electronic paper requiring flexibility, whenever the electronic paper is bent, the display device 20 similarly bends. However, a pressure is given between the circuit board 22 and the display sheet 21 with each bending. In this case, as illustrated in FIG. 1, the microcapsules 40 contact both the first electrodes 3 and the second electrode 4 in a point contact manner. Therefore, the load (pressure) applied per unit area of the contact portions becomes large. Specifically, a pressure of about 0.2 MPa or more and about 1.5 MPa or lower is applied. Even when such a pressure is applied between the circuit board 22 and the display sheet 21, it is preferable for the microcapsules 40 to have strength with which the spherical shape is maintained between the counter substrate 11 and the substrate 12. By structuring as described above, both pressure resistance and bleed resistance of the microcapsules 40 can be increased, and thus the display device 20 can stably operate over a long period of time.

Specifically, the capsule strength of the microcapsules 40 is preferably 0.6 MPa or more, more preferably 1.0 MPa or more, and still more preferably 3.0 MPa or more. The upper limit of the capsule strength is not particularly limited and is about 50 MPa, for example. The capsule strength of the microcapsules 40 refers to a compression strength per microcapsule measured using a microcompression tester (e.g., Product name: MCT-W500, manufactured by Shimadzu Corp.).

Moreover, the microcapsules 40 preferably have capsule strength with which the microcapsules 40 are not crushed even when a steel ball is dropped from a height of 10 cm or more, more preferably 20 cm or more, and still more preferably 30 cm or more in a steel ball drop test. In general, when the microcapsules 40 have only capsule strength with which the microcapsules 40 are crushed when a steel ball is dropped from a height lower than the height mentioned above in a steel ball drop test, there is a possibility that, when the display device 20 using such microcapsules 40 is accidentally dropped, the microcapsules 40 are crushed depending on a drop impact, resulting in a failure of data display in the crushed portion (pixel). The steel ball drop test is carried out by placing the display device 20 on a 3 mm thick butadiene rubber, vertically dropping a steel ball with a diameter of 11 mm and a mass of 5.468 g from an arbitrary height to the display layer 400 of the display device 20, and then observing the microcapsules 40 present in a portion where the steel ball hits under an optical microscope.

The microcapsules 40 are not particularly limited because the microcapsules 40 a certain degree of softness and the shape thereof changes due to external pressure. When there is no external pressure, the microcapsules 40 preferably have a particular shape, such as a true spherical shape. More specifically, the microcapsules 40 are preferably present between the counter substrate 11 and the substrate 12 while maintaining the shape more similar to a spherical shape.

With respect to the spherical degree of the microcapsules 40, the degree can be indicated while defining a ratio of the width of the microcapsules 40 and the height of the microcapsules 40 (Width of the microcapsules 40/Height of the microcapsules 40) as an index. The width of the microcapsules 40/the height of the microcapsules 40 (average value) is obtained by, for example, determining the average value of the particle size to each of the height (thickness direction) and the width (plane direction) of each microcapsule 40 in the display layer 400, and then determining the ratio (width/height) of these average values.

The width of the microcapsules 40/the height of the microcapsules 40 (average value) thus determined is not particularly limited and is preferably about 1.0 or more and about 1.2 or lower and more preferably about 1.0 or more and about 1.15 or lower. When the width of the microcapsules 40/the height of the microcapsules 40 (average value) is within the ranges mentioned above, it can be said that the microcapsules 40 are present between the counter substrate 11 and the substrate 12 in a state wherein an almost spherical shape is maintained. Due to the fact that the microcapsules 40 maintaining an almost spherical shape are arranged in the display layer 400 so that the microcapsules 40 adjacent to each other in the plane direction contact each other and are not laid on top each other in the thickness direction as described above, the display device 20 having the display layer 400 demonstrates high contrast.

The particle size of the microcapsules 40 is not particularly limited and is preferably about 5 μm or more and about 300 μm or lower, more preferably about 10 μm or more and about 200 μm or lower, and still more preferably about 15 μm or more and about 150 μm or lower. When the particle size of the microcapsules 40 is lower than 5 μm, there is a possibility that a sufficient display concentration is not obtained, although depending on the hue, particle size, amount (number), etc., of the electrophoretic particles contained in the microcapsules 40. On the contrary, when the particle size of the microcapsule exceeds 300 μm, there is a possibility that the capsule strength of the microcapsules 40 decreases, the electrophoretic properties of the electrophoretic particles 5 in the electrophoretic dispersion liquid 10 enclosed in the microcapsules 40 are not sufficiently demonstrated, and a drive voltage for display becomes high, although depending on the structure (constituent materials and the like) of the microcapsules 40. The particle size of the microcapsules 40 refers to a volume average particle size measured with a laser diffraction/scattering particle size distribution meter (e.g., Product name: LA-910, manufactured by Horiba Ltd., Coulter counter Multisizer 3, manufactured by BECKMAN COULTER).

The fluctuation coefficient (i.e., narrowness of the particle size distribution) of the particle size of the microcapsules 40 is not particularly limited and is preferably 30% or lower, more preferably 20% or lower, and still more preferably 10% or lower. When the fluctuation coefficient of the particle size of the microcapsules 40 exceeds 30%, the number of the microcapsules 40 having an effective particle size is small and thus a large number of microcapsules need to use. Moreover, even when the same voltage is applied between the first electrode 3 and the second electrode 4, the size of an acting electric field is different among the two or more microcapsules 40, and thus there is a possibility that the display device properties decrease.

The particle size of the microcapsules 40 or the fluctuation coefficient thereof described above are greatly dependent on the particle size or the particle size distribution of a dispersion liquid that is dispersed in an aqueous medium when manufacturing the microcapsules 40. Therefore, the microcapsules 40 having a desired particle size or fluctuation coefficient can be obtained by adjusting the dispersion conditions of the dispersion liquid as appropriate.

The constituent materials of such a capsule main body 401 are not particularly limited and mentioned are, for example, gelatin, composite materials of gum arabic and gelatin, and various rein materials, such as urethane resin, melamine resin, urea resin, epoxy resin, phenol resin, acrylic resin, urethane resin, olefin resin, polyamide, and polyether. The constituent materials can be used singly or in combination of two or more kinds thereof.

The electrophoretic dispersion liquid 10 enclosed in the capsule main body 401 is obtained by dispersing (suspending) the electrophoretic particles 5 in the liquid phase dispersion medium 6. The electrophoretic particles 5 contain two or more positively or negatively charged white particles (first particles) 5*a* and colored particles (second particles) 5*b* that are charged with polarity opposite to that of the white particles and have light reflectance lower than that of the white particles.

The dispersion of the electrophoretic particles 5 in the liquid phase dispersion medium 6 can be carried out by one of a paint shaker method, a ball mill method, a media mil method, an ultrasonic dispersion method, a stirring and dispersing method, etc., or by combining two or more kinds thereof, for example.

As the liquid phase dispersion medium 6, one having low solubility in the capsule main body 401 and relatively high insulation properties is preferably used. Mentioned as the liquid phase dispersion medium 6 are, for example, various kinds of water (e.g., distilled water and pure water), alcohols, such as methanol, cellosolves, such as methyl cellosolve, esters, such as methyl acetate, ketones, such as acetone, aliphatic hydrocarbons (liquid paraffin), such as pentane, cycloaliphatic hydrocarbon, such as cyclohexane, aromatic hydrocarbons, such as benzene, halogenated hydrocarbons, such as methylene chloride, aromatic heterocycles, such as pyridine, nitrils, such as acetonitrile, amides, such as N,N-dimethyl formamide, and various kinds of oils, such as carboxylic acid salt, silicone oil, or other oils, and the substances can be used singly or as a mixture thereof.

In particular, as the liquid phase dispersion medium 6, one containing aliphatic hydrocarbons (liquid paraffin) or silicone oil as the main ingredients is preferable. The liquid phase dispersion medium 6 containing liquid paraffin or silicone oil as the main ingredients is preferable in terms that the aggregation inhibitory effect of the electrophoretic particles 5 is high and the affinity for the constituent materials of the capsule main body 401 is low (low solubility). Thus, deterioration with time of the display performance of the display device 20 can be more certainly prevented or suppressed. Moreover, the liquid paraffin or silicone oil is preferable also in terms that the weather resistance is excellent and the safety is also high due to not having an unsaturated bond.

In the liquid phase dispersion medium 6, various additives, such as electrolytes, surfactants (anionic or cationic), such as alkenyl succinic acid ester, electric charge control agents containing particles of metal soap, resin materials, rubber materials, oils, varnish, compound, and the like, dispersants, such as a silane coupling agent, lubricants, and stabilizers, may be added as required, for example. When coloring the liquid phase dispersion medium 6, various dyes, such as anthraquinone dyes, azo dyes, and indigoid dyes, may be dissolved in the liquid phase dispersion medium 6 as required.

The electrophoretic particles 5 are particles that can perform electrophoresis in the liquid phase dispersion medium 6 due to the fact that the electrophoretic particles 5 have electric charges and an electric field acts thereon. For the electrophoretic particles 5, any kinds of particles can be used without particular limitation insofar as the particles have an electric charge and at least one of pigment particles, resin particles, and composite particles thereof is preferably used. These particles have advantages in that the particles are easy to manufacture and the electric charges can be relatively easily controlled.

Mentioned as pigments constituting the pigment particles are, for example, black pigments, such as aniline black, carbon black, titanium black, and copper chromite, white pigments, such as titanium oxide and antimony oxide, azo pigments, such as monoazo pigments, yellow pigments, such as isoindolinone and chrome yellow, red pigments, such as quinacridone red and chromium vermilion, blue pigments, such as phthalocyanine blue and indanthrene blue, and green pigments, such as phthalocyanine green. The pigments can be used singly or in combination of two or more kinds thereof.

Mentioned as resin materials constituting the resin particles are, for example, acrylic resin, urethane resin, urea resin, epoxy resin, polystyrene, and polyester. The resin materials can be used singly or in combination of two or more kinds thereof.

Mentioned as the composite particles are, for example, pigment particles whose surface is covered with resin material or other pigments, resin particles whose surface is covered with pigments, and a mixture obtained by mixing pigments and resin materials with a suitable composition ratio.

As the pigment particles whose surface is covered with other pigments, titanium oxide particles whose surface is covered with silicon oxide or aluminum oxide can be mentioned and such particles are suitably used as the white particles 5*a*. Carbon black particles or particles whose surface is covered are suitably used as the colored particles (black particles) 5*b*.

The shape of the electrophoretic particles 5 is not particularly limited and is preferably a globular shape.

The average particle size of the electrophoretic particles 5 is not particularly limited and is preferably 0.1 to 5 μm, more preferably 0.1 to 4 μm, and still more preferably 0.1 to 3 μm. When the average particle size of the electrophoretic particles 5 is lower than 0.1 μm, sufficient chromaticity is not obtained, which results in the fact that, when used for an electrophoretic display device, the contrast decreases and display becomes indistinct in some cases. On the contrary, when the average particle size of the electrophoretic particles 5 exceeds 5 μm, the coloring degree of the particles themselves needs to be higher than necessary, which results in the fact that the used amount of pigments and the like increases or, when used for an electrophoretic display device, prompt movement of the electrophoretic particles becomes difficult and the response rate (display responsiveness) decreases in some cases in a portion to which a voltage is applied for display.

The average particle size of the electrophoretic particles 5 refers to a volume average particle size measured with a dynamic light scattering particle size distribution meter (e.g., Product name: LB-500, manufactured by Horiba Ltd.).

The specific gravity of the electrophoretic particles 5 is preferably set to be almost equal to the specific gravity of the liquid phase dispersion medium 6. Thus, the electrophoretic particles 5 can stay at a given position for a long period of time in the liquid phase dispersion medium 6 even after stopping the voltage application between the electrodes 3 and 4. More specifically, memory properties can be given to the display device 20, and thus displayed information is held for a long period of time.

The binder 41 contained in the display layer 400 is supplied for the purpose of, for example, joining the counter substrate 11 and the substrate 12, for the purpose of fixing the microcapsules 40 between the counter substrate 11 and the substrate 12, for the purpose of fixing the microcapsules 40 to each other, for the purpose of securing the insulation properties between the first electrodes 3 and second electrode 4, and the like. Thus, the durability and the reliability of the display device 20 can be further increased.

Preferably used for the binder 41 are resin materials (insulative resin materials or resin materials in which only a micro current flows) that are excellent in affinity (adhesiveness) with the counter substrate 11, the second electrode 4, and the capsule main body 401 (microcapsules 40) and are excellent in insulation properties.

Mentioned as such a binder 41 are, for example, synthetic resin binders, such as (meth)acrylic resin, (meth)acrylic urethane resin, polyvinyl chloride resin, polyvinylidene chloride resin, melamine resin, urethane resin, styrene resin, alkyd resin, phenol resin, epoxy resin, polyester resin, polyvinyl alcohol resin, (meth)acrylic silicone resin, alkylpolysiloxane resin, silicone resin, silicone alkyd resin, silicone urethane resin, silicone polyester resin, and polyalkylene glycol resin, synthetic rubber or crude rubber binders, such as ethylene-propylene copolymerized rubber, polybutadiene rubber, styrene-butane diene rubber, and acrylonitrile-butadiene rubber, and thermoplastic or thermosetting polymer binders, such as cellulose nitrate, cellulose acetate butyrate, cellulose acetate, ethyl cellulose, hydroxypropylmethyl cellulose, and hydroxyethyl cellulose. The substances can be used singly or in combination of two or more kinds thereof.

Among these binders 41, (meth)acrylic resin, polyester resin, urethane resin, and polyalkylene glycol resin are preferably used and (meth)acrylic resin is particularly preferably used in terms that the dispersibility of the microcapsules 40 is relatively favorable and the adhesiveness with the counter substrate 11, the substrate 12, and the microcapsules 40 is excellent.

Furthermore, the sealing portions 7 are provided between the substrate 12 and the counter substrate 11 along the edges thereof. The second electrode 4 and the display layer 400 are sealed in an airtight manner by the sealing portions 7. Thus, the permeation of moisture into the display device 20 (display sheet 21) can be prevented, so that the degradation of the display performance of the display device 20 (display sheet 21) can be more certainly prevented.

Mentioned as constituent materials of the sealing portions 7 are, for example, various resin materials, such as: thermoplastic resin, such as acrylic resin, urethane resin, and olefin resin and thermosetting resin, such as epoxy resin, melamine resin, and phenol resin. The resin can be used singly or in combination of two or more kinds thereof. The sealing portions 7 may be provided as required and can also be omitted.

2. Operation Method of Display Device

Such a display device 20 operates as follows.

For example, the display device 20 is structured so that the second electrode 4 is grounded and a given voltage is applied to the first electrodes 3 by a voltage application portion (power supply) which is not illustrated and, when a voltage is applied to the first electrodes 3 by the voltage application portion, a potential difference arises between the first electrodes 3 and the second electrode 4 to generate an electric field in accordance therewith. When the electric field acts on the electrophoretic particles 5 in the microcapsules 40, the electrophoretic particles 5 (colored particles 5*b*, white particles 5*a*) move (electrophoresis) toward either the first electrodes 3 or the second electrode 4 in the liquid phase dispersion medium 6 in accordance with the direction of the electric field.

Hereinafter, the case where particles having positive electric charges are used as the white particles 5*a* and particles having negative electric charges is used as the colored particles (black particles) 5*b* will be described with reference to one microcapsule 40.

White Display State—Second State

Figure 2A:
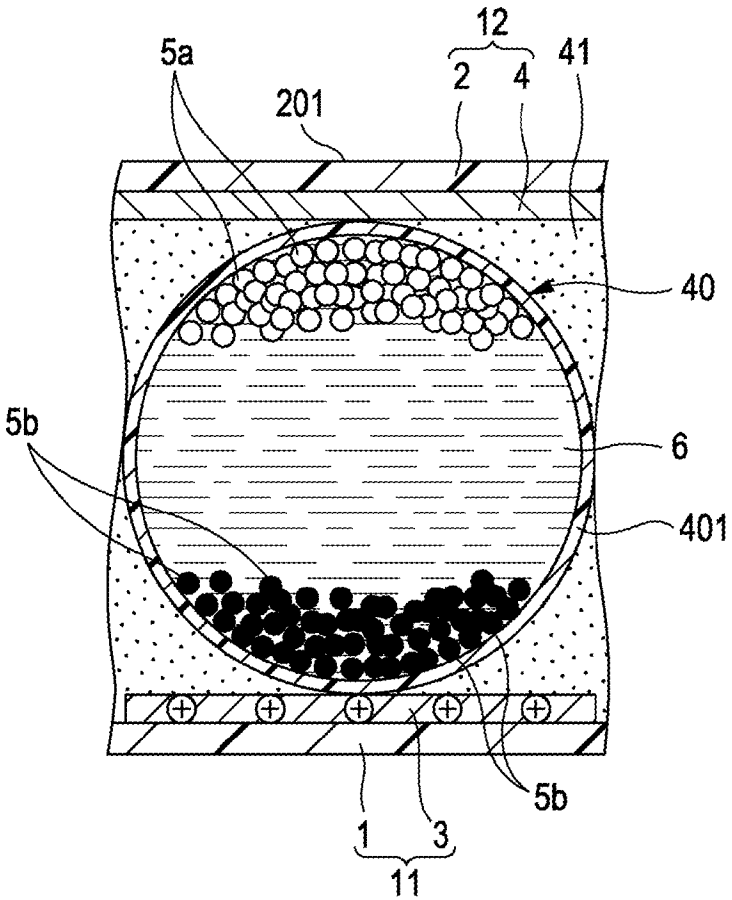

As illustrated in FIG. 2A, when a voltage for positively charging the first electrode 3 is applied to the first electrode 3, an electric field (electric field for white display) generated by the voltage application acts on the electrophoretic particles 5. Due to the action of the electric field, the white particles 5*a* move to the second electrode 4 side and gather to the second electrode 4 and the colored particles 5*b* move to the first electrode 3 side and gather to the first electrode 3. Then, when the voltage application is stopped, only the white particles 5*a* move in such a manner as to be dispersed in the liquid phase dispersion medium 6 as illustrated in FIG. 2B. In such a state, when the microcapsule 40 is viewed from the display surface 201 side, white color which is the color of the white particles 5*a* is displayed. In such a state, the white color is displayed due to reflection and scattering of light by the white particles 5*a*. Therefore, by dispersing the white particles 5*a* in the liquid phase dispersion medium 6, brighter white color can be displayed (i.e., a high contrast can be demonstrated).

Herein, there are various methods for making the colored particles 5*b* stay at the first electrode 3 side and dispersing the white particles 5*a* in the liquid phase dispersion medium 6 when the voltage application is stopped and the following methods are mentioned as some examples.

For example, a method for positively charging the capsule main body 401 of the microcapsules 40 is mentioned. According to the method, after stopping the voltage application, the colored particles 5*b* can be made to stay at the second electrode 4 side due to the attraction (electrostatic attraction) generated between the same and the capsule main body 401 and, on the contrary, the white particles 5*a* can be dispersed in the liquid phase dispersion medium 6 due to the repulsive force generated between the same and the capsule main body 401. It is preferable that the charge amount of the capsule main body 401 be small in order not to block the electrophoresis of the electrophoretic particles 5*a* due to the attraction and the repulsive force.

Moreover, a method for physically adsorbing or chemically bonding polymers having a high affinity for the capsule main body 401 to the surface of the colored particles 5*b* is mentioned, for example. According to the method, the affinity for the capsule main body 401 of the colored particles 5*b* becomes superior to the affinity for the capsule main body 401 of the white particles 5*a*. Therefore, after stopping the voltage application, the colored particles 5*b* can be made to stay at the second electrode 4 side, and the white particles 5*a* can be dispersed in the liquid phase dispersion medium 6.

Moreover, a method for physically adsorbing or chemically bonding polymers having a high compatibility with the liquid phase dispersion medium 6 to the surface of the white particles 5*a* is mentioned, for example. According to the method, the dispersibility of the white particles 5*a* in the liquid phase dispersion medium 6 becomes superior to that of the colored particles 5*b* in the liquid phase dispersion medium 6. Mentioned as such polymers are, for example, a polymer having a group having reactivity with the electrophoretic particles and having a chargeable functional group, a polymer having reactivity with the electrophoretic particles and having a long chain alkyl chain, a long chain ethylene oxide chain, a long chain alkyl fluoride chain, a long chain dimethyl silicone chain, or the like, and a polymer having reactivity with the electrophoretic particles and having a chargeable functional group and a long chain alkyl chain, a long chain ethylene oxide chain, a long chain alkyl fluoride chain, a long chain dimethyl silicone chain, or the like.

Black Display State—First State

Figure 3A:
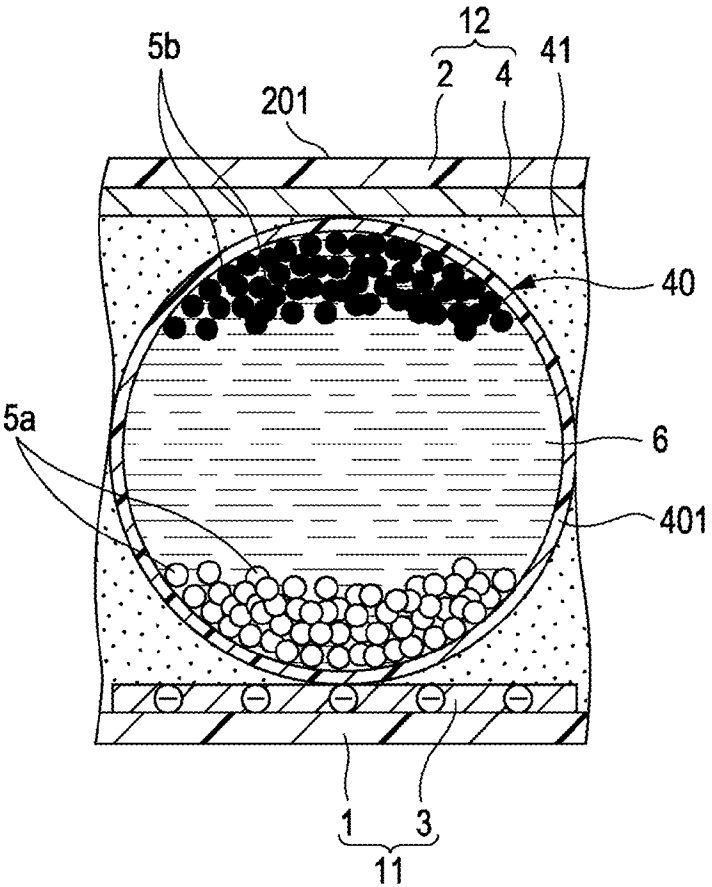

On the contrary to the white display state, when a voltage for negative charging the first electrode 3 as illustrated in FIG. 3A is applied to the first electrode 3, an electric field (electric field for black display) generated by the voltage application acts on the electrophoretic particles 5. Due to the action of the electric field, the white particles 5*a* move to the first electrode 3 side and gather to the first electrode 3 and the colored particles 5*b* move to the second electrode 4 side and gather to the second electrode 4. When the voltage application is stopped, only the white particles 5*a* move in such a manner as to be dispersed in the liquid phase dispersion medium 6 as illustrated in FIG. 3B. In such a state, when the microcapsule 40 is viewed from the display surface 201 side, black color which is the color of the colored particles 5*b* is displayed.

By performing such operation in each microcapsule 40, i.e., by combining as appropriate the microcapsules 40 in the white display state and the microcapsules 40 in the black display state, a desired image is displayed on the display surface 201 of the display device 20.

In the above description, the white display state and the black display state are described. When it is abruptly intended to switch the state of the microcapsule 40 from the black display state to the white display state, the following problems arise.

As illustrated in FIG. 4A, when the electric field generated by the application of the voltage for positively charging the first electrode 3 to the first electrode 3 acts on the microcapsule 40 in the black display state, the white particles 5*a* change the state where the white particles 5*a* are dispersed in the liquid phase dispersion medium 6 and move to the second electrode 4 side and the colored particles 5*b* move to the first electrode 3 side from the second electrode 4 side. Since the white particles 5*a* are dispersed in the liquid phase dispersion medium 6, the distance to the second electrode 4 is entirely short, and thus the white particles 5*a* reach the second electrode 4 side in a short period of time after the electric field acts. Therefore, the white particles 5*a* reach the second electrode 4 side before the colored particles 5*b* start to move toward the second electrode 4 side (before move over a potential barrier generated by an interaction with the inner wall of the capsule main body 401) or immediately after the colored particles 5*b* start to move.

Thus, as illustrated in FIG. 4B, some colored particles 5*b* are surrounded by the two or more white particles 5*a*. The colored particles 5*b* surrounded by the two or more white particles 5*a* cannot move to the first electrode 3 side, and stay at the second electrode 4 side as they are.

As illustrated in FIG. 4C, after the voltage application is stopped, the white particles 5*a* move in such a manner as to be uniformly dispersed in the liquid phase dispersion medium 6, so that the surrounding of the colored particles 5*b* by the two or more white particles 5*a* is released. However, since the colored particles 5*b* maintain the position as they are, the colored particles 5*b* left at the second electrode 4 side do not move to the first electrode side. Therefore, when the microcapsule 40 is viewed from the display surface 201 side in such a state, a gray color (substantially black depending on the number of the colored particles 5*b* left at the second electrode 4 side) which is a neutral color of the white particles 5*a* and the colored particles 5*b* is displayed.

Thus, when the colored particles 5*b* are left at the second electrode 4 side, an afterimage of an image displayed before arises on an image displayed on the display surface 201, which deteriorates the image visibility and reduces the image quality. For example, even when the image is switched from a first image of a checkered pattern illustrated in FIG. 5A to a second image of a checkered pattern illustrated in FIG. 5B, an image illustrated in FIG. 5B is not displayed and, as illustrated in FIG. 5C, regions (microcapsules 40) S1 in the black display state in the first image and in the white display state in the second image are displayed in a gray color, resulting in the fact that the afterimages resulting from the first image are displayed with being superimposed on the second image.

Then, in order to solve the problems, the display device 20 is structured in such a manner as to prevent the above-described generation of afterimages by providing a reset period for causing a resetting electric field E to act at least on the microcapsules 40 in the black display state. Hereinafter, the structure will be specifically described.

The resetting electric field E is an electric field that is caused to act on each microcapsule 40 before causing the electric field for displaying the second image to act thereon. A resetting electric field V is an electric field for displaying an all white display (a state where all the regions are in the white display state) on the display surface 201 once. More specifically, when switching the image from the first image illustrated in FIG. 5A to the second image illustrated in FIG. 5B, an all white image in which all the regions are white is displayed between the first image and the second image. The resetting electric field E can be generated by applying a given voltage to the first electrode 3.

As illustrated in FIG. 6, the reset period in which the resetting electric field E is acting has a first period E1 and a second period E2 that starts simultaneously with the termination of the first period E1. FIG. 6 illustrates a waveform of the voltage to be applied to the first electrode 3, in which the period in which a (−) voltage is applied to the first electrode 3 is the first period E1 and the period in which a (+) voltage is applied thereto is the second period E2. Hereinafter, these two periods E1 and E2 will be described in detail one by one.

In the first period E1, an electric field for negatively charging the first electrode 3 side acts on the microcapsule 40. Therefore, in the first period E1, the white particles 5*a* dispersed in the liquid phase dispersion medium 6 move to the first electrode 3 side and the colored particles 5*b* move to the second electrode 4 side. Herein, since the colored particles 5*b* gather to the second electrode 4 side from the beginning, the movement is slight. By providing such a first period E1, the white particles 5*a* can be kept away from the second electrode 4 (colored particles 5*b*).

The period of the first period E1 is not particularly limited and is preferably 0.2 second (200 msec) or more. Thus, the white particles 5*a* can be sufficiently moved to the first electrode 3 side. More specifically, the white particles 5*a* can be sufficiently kept away from the colored particles 5*b*. The upper limit of the first period E1 is not particularly limited and is preferably within 2 seconds, for example, from the viewpoint of shortening the first period E1 as much as possible.

The strength (absolute value) of the resetting electric field E in the first period E1 is not particularly limited and is preferably 0.1 v/μm or more. Thus, the white particles can be more certainly moved to the first electrode 3 side. The upper limit of the resetting electric field E in the first period E1 is not particularly limited and is preferably 100 v/μm or lower from the viewpoint of problems in terms of the safety, power-saving drive, and the like of the device.

The strength of the resetting electric field E in the first period E1 is preferably equal to the strength of the electric field that is caused to act for switching the state of the microcapsule 40 to a black display state. In other words, the voltage to be applied to the first electrode 3 in the first period E1 and the voltage to be applied to the first electrode 3 when switching the state of the microcapsule 40 to a black display state are preferably equal to each other. Thus, the device structure (circuit structure) becomes simple.

In the second period E2, an electric field for positively charging the first electrode 3 side acts on the microcapsule 40. Therefore, in the second period E2, the white particles 5*a* move to the second electrode 4 side and the colored particles 5*b* move to the first electrode 3 side. Herein, since the white particles 5*a* are moved to the first electrode 3 side and are sufficiently kept away from the colored particles 5*b* by the first period E1, the white particles 5*a* can be prevented from reaching the second electrode 4 side before the colored particles 5*b* start to move or immediately after the colored particles 5*b* start to move. Therefore, it can be prevented that some colored particles 5*b* are surrounded by the two or more white particles 5*a* at the second electrode 4 side and the colored particles 5*b* stay at the second electrode 4 side, and thus the colored particles 5*b* can be effectively moved to the first electrode 3 side.

When such an E2 period is completed, only the white particles 5*a* are dispersed in the liquid phase dispersion medium 6, and then the microcapsule 40 enters a white display state illustrated in FIG. 2B.

The period of the second period E2 is not particularly limited and is preferably 0.2 second (200 msec) or more. Thus, the white particles 5*a* can be more certainly moved to the second electrode 4 side and the colored particles 5*b* can be moved to the first electrode 3 side. The upper limit of the second period E2 is not particularly limited and is preferably within 2 seconds, for example, from the viewpoint of shortening the second period E2 as much as possible.

The strength (absolute value) of the resetting electric field E in the second period E2 is not particularly limited and is preferably 0.1 v/μm or more. Thus, the white particles 5*a* and the colored particles 5*b* can be more certainly and smoothly moved. The upper limit of the resetting electric field E in the second period E2 is not particularly limited and is preferably 100 v/μm or lower from the viewpoint of problems in terms of the safety, power-saving driving, and the like of the device.

The strength of the resetting electric field E in the second period E2 is preferably equal to the strength of the electric field that is caused to act when switching the state of the microcapsule 40 to a white display state. In other words, the voltage to be applied to the first electrode 3 in the second period E2 and the voltage to be applied to the first electrode 3 when switching the state of the microcapsule 40 to a black display state are preferably equal to each other. Thus, the device structure (circuit structure) becomes simple.

By causing the resetting electric field E to act on the microcapsule 40 before causing an electric field for displaying the second image to act thereon, i.e., by providing the reset period, the state of the display surface 201 can be switched to an all white display state before displaying the second image, and then the first image can be completely eliminated. Therefore, the afterimages resulting from the first image when writing-in the second image can be reduced.

Herein, the resetting electric field E may be caused to act only on the microcapsules 40 in the black display state or may be caused to act on all the microcapsules 40 and is preferably caused to act only on the microcapsules 40 in the black display state. Thus, an unnecessary electric field can be prevented from acting on the microcapsules 40 in the white display state from the beginning, and thus the reliability of the device increases and power-saving can be achieved. When the resetting electric field is caused to act only on the microcapsules 40 in the black display state, a storage portion that memorizes the position of the microcapsules 40 switched into the black display state in the immediately preceding image, and then the resetting electric field may be caused to act on the microcapsules 40 in the black display state based on the information stored in the storage portion, for example.

The following electric field may be caused to act as a modification of the resetting electric field (reset period).

As illustrated in FIG. 7, a reset period which is a period when a resetting electric field E' is acting has a first period E1, a third period E3 to be started simultaneously with the termination of the first period 1, and a second period E2 to be started simultaneously with the termination of the third period 3. FIG. 7 illustrates a waveform of the voltage to be applied to the first electrode 3, in which a period in which a (−) voltage is applied to the first electrode 3 is the first period E1, a period in which no voltages are applied is the third period E3, and a period in which a (+) voltage is applied to the first electrode 3 is the second period E2. The first period E1 and the second period E2 are the same as the above-described structures and thus only the third period E3 will be described in detail.

In the third period E3, no electric fields are generated. More specifically, no voltages are applied to the first electrode 3. Since the reset period has the third period E3, the movement of the electrophoretic particles 5 can be made to stop (slowing-down) once, and therefore the electrophoretic particles 5 can be smoothly moved in the next second period E2.

The period of the third period E3 is not particularly limited and is preferably 2 seconds or lower. Thus, the white particles 5*a* attracted to the first electrode 3 side by the first period E1 can be prevented from being re-dispersed in the liquid phase dispersion medium 6.

Second Embodiment

Next, a second embodiment of the display device of the invention will be described.

Figure 8:
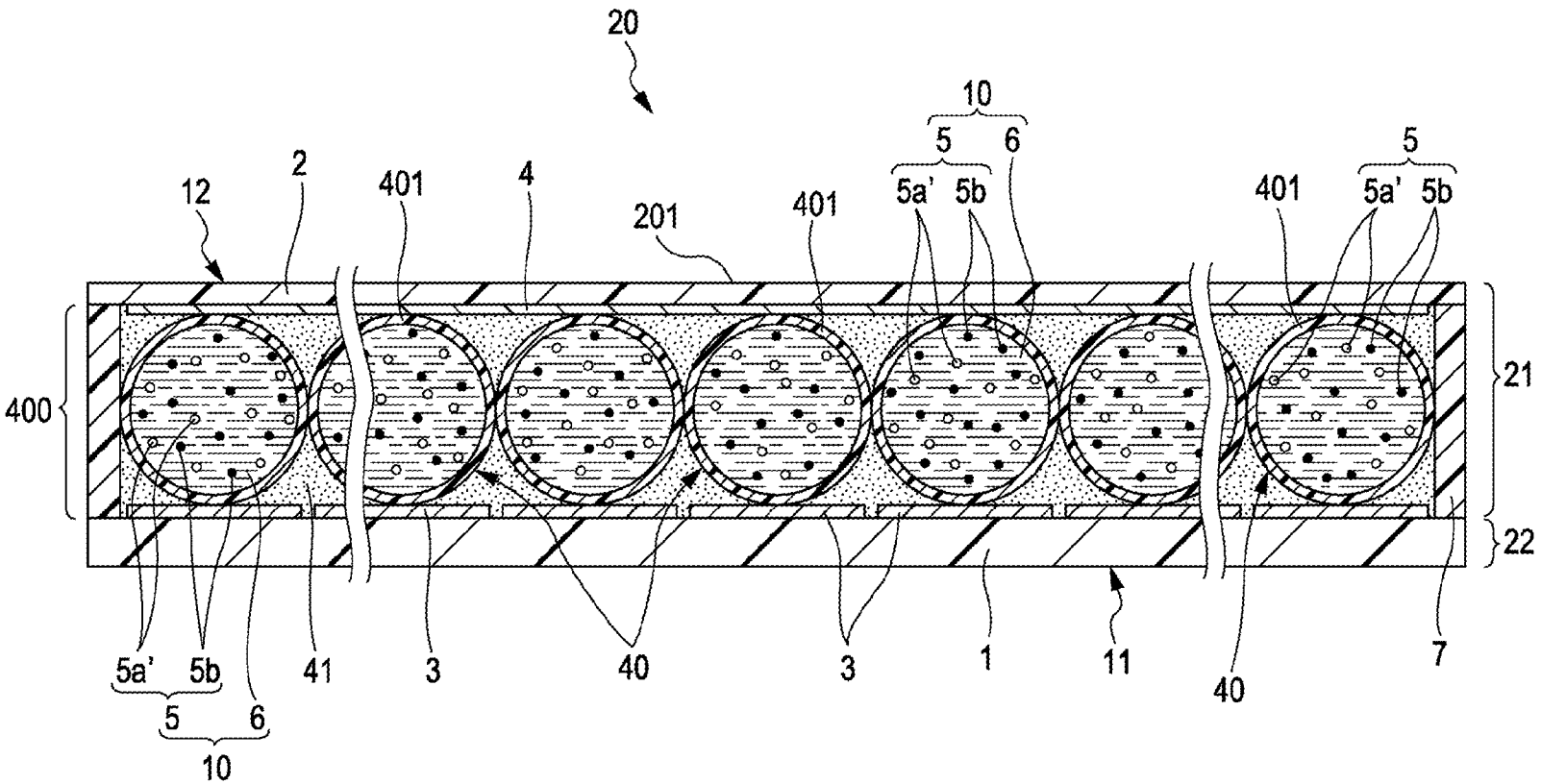
FIG. 8 is a longitudinal cross sectional view schematically illustrating a second embodiment of the display device of the invention.

FIG. 8 is a longitudinal cross sectional view schematically illustrating the second embodiment of the display device of the invention.

Hereinafter, the display device according to the second embodiment will be described but the description is given focusing on differences from the above-described first embodiment and the description of the same matter will be omitted.

The display device according to this embodiment is the same as that of the first embodiment of the above, except that white particles 5*a*' are not charged.

As illustrated in FIG. 8, an electrophoretic dispersion liquid 10 in which colored particles 5*b* and non-charged white particles 5*a*' are dispersed in the liquid phase dispersion medium 6 is enclosed in each microcapsule 40. Also in such a microcapsule 40, when it is abruptly intended to switch the state from a black display state to a white display state, problems arise in the same manner as in the above-described first embodiment in which the colored particles 5*b* are surrounded by two or more white particles 5*a*' near the electrode 4, and the particles are displayed as afterimages. However, since the mechanism is different from that of the first embodiment, the mechanism will be briefly described below.

When an electric field for positively charging the first electrode 3 is caused to act on the microcapsule 40 in the black display state, the colored particles 5*b* are moved to the first electrode 3 side by electric attraction. In contrast, since the white particles 5*a*' are not charged, the white particles 5*a*' do not move toward either the first electrode 3 or the second electrode 4 by electric power but move to the second electrode 4 side by the convection generated when the colored particles 5*b* and added ions move. Thus, some colored particles 5*b* are surrounded by two or more white particles 5*a*'. Thus, the same problem as that of the first embodiment arises.

Then, the display device 20 of the second embodiment is also structured in such a manner as to prevent the generation of afterimages by causing the resetting electric field E to act on the microcapsule 40 in the black display state. Hereinafter, the structure will be specifically described.

In the first period E1, an electric field for negatively charging the first electrode 3 side acts on the microcapsule 40. Therefore, the colored particles 5*b* move to the second electrode 4 side in the first period E1. Since the colored particles 5*b* gather to the second electrode 4 side from the beginning, the movement is slight. However, the white particles 5*a*' move to the second electrode 4 side by the convection (flow of the liquid phase dispersion medium 6) generated by the movement and the convection generated by the movement of the added ions. By providing such a first period E1, the white particles 5*a*' can be kept away from the second electrode 4 (colored particles 5*b*).

In the second period E2, an electric field for positively charging the first electrode side acts on the microcapsule 40. Therefore, the colored particles 5*b* move to the first electrode 3 side in the second period E2. Herein, since the white particles 5*a*' are moved to the first electrode 3 side and sufficiently kept away from the colored particles 5*b* by the first period E1, the white particles 5*a*' can be prevented from reaching the second electrode 4 side in a short period of time by the convection generated by the movement of the colored particles 5*b* and the added ions. Therefore, it can be prevented that some colored particles 5*b* are captured by two or more white particles 5*a*' at the second electrode 4 side and the colored particles 5*b* stay at the second electrod e 4 side.

When such a second period E2 is completed, only the white particles 5*a*' are dispersed in the liquid phase dispersion medium 6, so that the microcapsule 40 enters a white display state illustrated in FIG. 2B.

Also by such a second embodiment, the same effect as that of the above-described embodiment can be demonstrated.

Electronic Device

The above-described display device 20 can be placed in various electronic devices. Hereinafter, an electronic device of the invention having the display device 20 will be described.

Electronic Paper

First, an embodiment when the electronic device of the invention is applied to electronic paper will be described.

Figure 9:
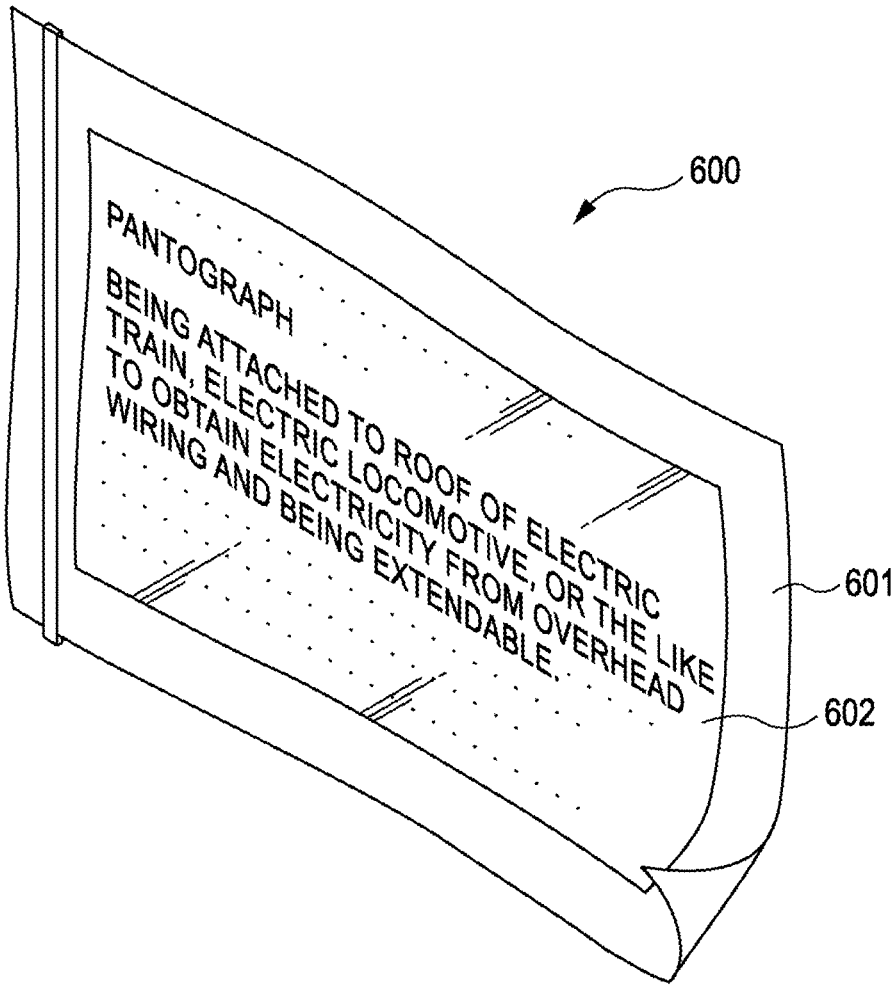
FIG. 9 is a perspective view illustrating an embodiment when an electronic device of the invention is applied to electronic paper.

FIG. 9 is a perspective view illustrating an embodiment in which the electronic device of the invention is applied to electronic paper.

An electronic paper 600 illustrated in FIG. 9 has a main body 601 constituted by a rewritable sheet having the same texture and softness as those of paper and a display unit 602.

In such electronic paper 600, the display unit 602 is constituted by the above-described display device 20.

Display

Next, an embodiment when the electronic device of the invention is applied to a display will be described.

Figure 10A:
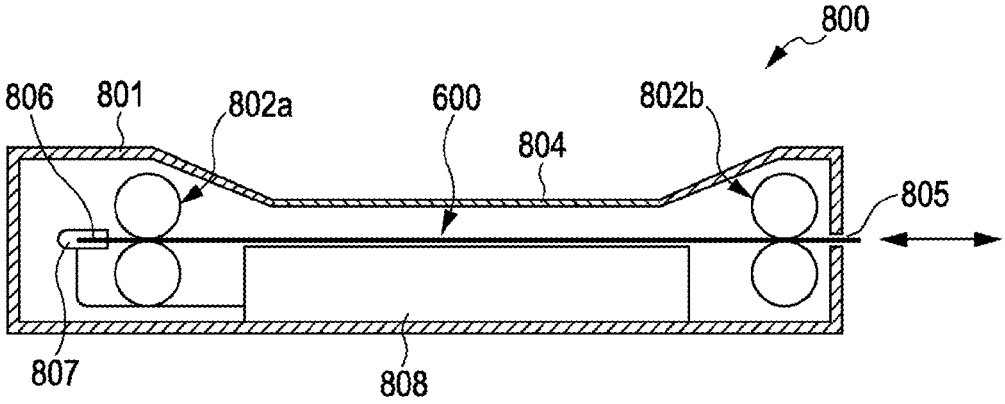
FIGS. 10A and 10B are views illustrating an embodiment when an electronic device of the invention is applied to a display.
Figure 10B:
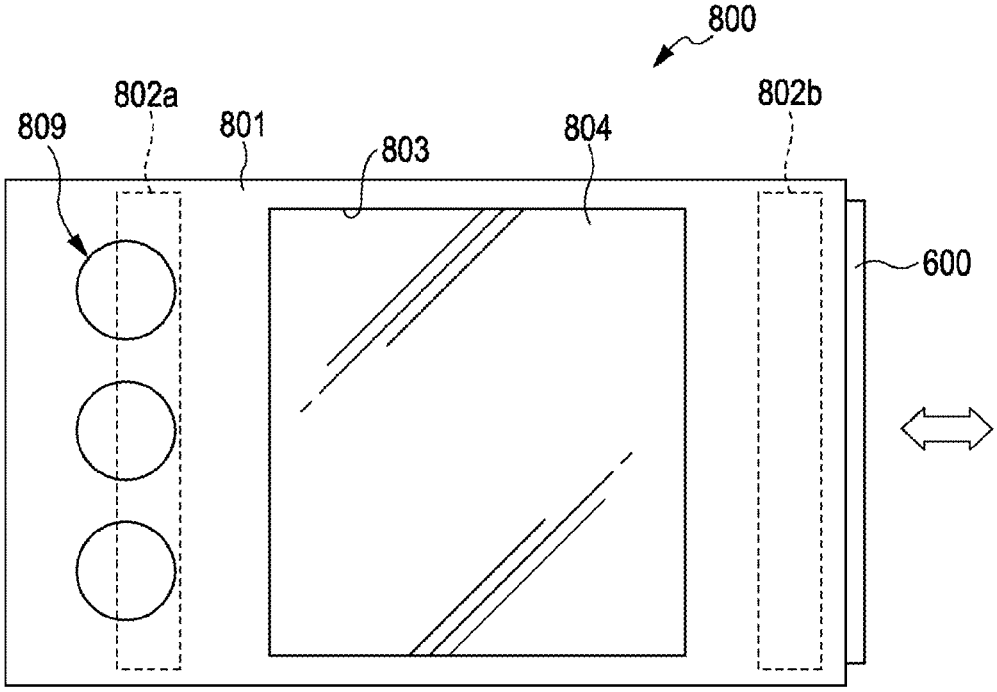

FIGS. 10A and 10B are views illustrating embodiments when the electronic device of the invention is applied to a display. Among the views, FIG. 10A is a cross sectional view and FIG. 10B is a plan view.

A display (display device) 800 illustrated in FIG. 10 has a main body portion 801 and the electronic paper 600 detachably provided to the main body portion 801. The electronic paper 600 has the above-described structure, i.e., the same structure as that illustrated in FIG. 9.

In the main body portion 801, an insertion port 805, from which the electronic paper 600 can be inserted, is formed at the side portion (right side in FIG. 10A) and two pairs of conveyance rollers 802*a* and 802*b* are provided therein. When the electronic paper 600 is inserted into the main body portion 801 through the insertion port 805, the electronic paper 600 is placed in the main body portion 801 with being held by the conveyance roller pairs 802*a* and 802*b*.

At the display surface side (front side of the sheet in FIG. 10B of the main body portion 801, a rectangular opening portion 803 is formed and a transparent glass plate 804 is fitted into the opening portion 803. Thus, the electronic paper 600 in a state where the electronic paper 600 is placed in the main body portion 801 can be visually recognized from the outside of the main body portion 801. More specifically, in the display device 800, the display surface is constituted by visually recognizing the electronic paper 600 placed in the main body portion 801 in the transparent glass plate 804.

At the tip portion in the insertion direction (left side in FIG. 10) of the electronic paper 600, a terminal portion 806 is provided. In the main body portion 801, a socket 807, to which the terminal portion 806 is connected in a state where the electronic paper 600 is placed in the main body portion 801, is provided. To the socket 807, a controller 808 and an operation portion 809 are electrically connected.

In such a display device 800, the electronic paper 600 is detachably placed in the main body portion 801, and thus the electronic paper 600 can be detached from the main body portion 801 and can be carried for use.

In such a display device 800, the electronic paper 600 is constituted by the above-described display device 20.

The electronic device of the invention is not limited to the above-described application and, for example, television, a view finder type or monitor-direct-view type videotape recorder, a car navigation device, a pager, an electronic scheduler, a calculator, an electronic newspaper, a word processor, a personal computer, a workstation, a TV phone, a POS terminal, and a device having a touch panel, and the like can be mentioned. The display device 20 can be applied to the display portion of these various electronic devices.

The display sheet, the display device, the electronic device, and the display sheet driving method of the invention are described above based on the embodiments illustrated in the drawings. However, the invention is not limited thereto and the structure of each portion can be replaced by an arbitrary structure having the same function. Other arbitrary structures may be added to the invention. The display sheet, the display device, the electronic device, and the display sheet driving method of the invention may have two or more arbitrary structures of the respective embodiments described above in combination.

The above-described first embodiment describes an aspect in which the white particles are positively charged and the colored particles are negatively charged but, in contrast thereto, the white particles may be negatively charged and the colored particles may be positively charged. In this case, the positive/negative of the resetting electric field may be reversed to that of the first embodiment.

The above-described embodiments are so-called microcapsule type display devices. However, the invention is not limited thereto and may have an aspect in which a contact particle containing layer containing contact particles and a scatterer or a colored object is divided with a partition, i.e., an aspect in which two or more cell spaces (spaces) divided by partitions are formed and each cell space is charged with an electrophoretic dispersion liquid, for example.

The above-described embodiment describes an aspect in which the capsule main body of the microcapsules is constituted by a single layer but the capsule main body of the microcapsules may be constituted by a multilayer of two or more layers.

EXAMPLES

1. Manufacture of Electrophoretic Display Device

<1> First, titanium oxide particles were prepared as white particles and titanium black particles were prepared as black particles, respectively. Then, these particles were dispersed in dimethyl silicone oil (liquid phase dispersion medium) to prepare an electrophoretic dispersion liquid. The surface of the titanium oxide particles and the titanium black particles was subjected to graft modification in such a manner as to be charged in reverse polarity to each other (titanium oxide particles: positive, titanium black particles: negative).

Subsequently, melamine, urea, an aqueous formaldehyde solution, and aqueous ammonia were mixed to prepare a capsule formation material of a composite resin of melamine resin and urea resin. Then, the electrophoretic dispersion liquid was added dropwise to the capsule formation material. Thus, a microcapsule precursor was obtained in which the electrophoretic dispersion liquid is enclosed in the capsule formed with the composite resin.

Subsequently, the microcapsule precursor and deionized water were mixed to obtain a capsule dispersion liquid. Next, polycarboxylic acid, an epoxy compound, and water were mixed to prepare a capsule formation material of epoxy resin. Subsequently, to the previously-prepared capsule dispersion, the capsule formation material of epoxy resin was added and further a crosslinking agent was added. Thus, an outer surface containing epoxy resin was formed on the surface of the microcapsule precursor (inner layer).

Through the above-described processes, a microcapsule in which the electrophoretic dispersion liquid is enclosed in a two-layer structured capsule main body. Thereafter, classification was performed to thereby obtain a microcapsule having an average particle size of 40 μm.

<2> Next, an acrylic binder was dissolved in ethanol to obtain an ethanol solution. To the ethanol solution, the microcapsule was added to prepare a microcapsule dispersion liquid. The mixing ratio of the microcapsule and the binder was adjusted to 1:1 in terms of weight ratio.

Next, a PET-ITO substrate on which an electrode containing ITO was formed was prepared. Subsequently, the microcapsule dispersion liquid was applied onto the ITO of the PET-ITO substrate by a doctor blade method to form a display layer having an average thickness of 45 μm.

<4> Next, a circuit board (back plane) in which pixel electrodes containing ITO were formed in the shape of a matrix was disposed on the display layer, and then joined using a roll laminator to thereby obtain a joined body.

<5> Next, the edge portion (periphery portion) of the joined body was sealed with an epoxy adhesive. Thus, the display device 20 illustrated in FIG. 1 was obtained.

2. Driving of Display Device

Example 1

First, an electric field for a black display (0.1 second and 0.33 v/μm) was caused to act on each microcapsule of the display device, so that a black display state was achieved on the entire region of the display surface. Next, 1 second after achieving the black display state, a resetting electric field E was caused to act on each microcapsule in order to reset the black display state and achieve a white display state. Next, an electric field for a white display (0.1 second and 0.33 v/μm) was caused to act on each microcapsule. The strength and time of the resetting electric field are as follows:

First Period E1: 0.1 second and 0.33 v/μm (absolute value);
Third period E3: 0 second;
Second period E2: 0.1 second and 0.33 v/μm (absolute value).

Example 2

First, an electric field for a black display (0.2 second and 0.33 v/μm) was caused to act on each microcapsule of the display device, so that a black display state was achieved on the entire region of the display surface. Next, 1 second after achieving the black display state, a resetting electric field E was caused to act on each microcapsule in order to reset the black display state and achieve a white display state. Next, an electric field for a white display (0.2 second and 0.33 v/μm) was caused to act on each microcapsule. The strength and time of the resetting electric field are as follows:

First Period E1: 0.2 second and 0.33 v/μm (absolute value);
Third period E3: 0 second;
Second period E2: 0.2 second and 0.33 v/μm (absolute value).

Example 3

First, an electric field for a black display (0.4 second and 0.33 v/μm) was caused to act on each microcapsule of the display device, so that a black display state was achieved on the entire region of the display surface. Next, 1 second after achieving the black display state, a resetting electric field E was caused to act on each microcapsule in order to reset the black display state and achieve a white display state. Next, an electric field for a white display (0.4 second and 0.33 v/μm) was caused to act on each microcapsule. The strength and time of the resetting electric field are as follows:

First Period E1: 0.4 second and 0.33 v/μm (absolute value);
Third period E3: 0 second;
Second period E2: 0.4 second and 0.33 v/μm (absolute value).

Example 4

First, an electric field for a black display (0.2 second and 0.33 v/μm) was caused to act on each microcapsule of the display device, so that a black display state was achieved on the entire region of the display surface. Next, 1 second after achieving the black display state, a resetting electric field E was caused to act on each microcapsule in order to reset the black display state and achieve a white display state. Next, an electric field for a white display (0.2 second and 0.33 v/μm)

was caused to act on each microcapsule. The strength and time of the resetting electric field are as follows:
First Period E1: 0.2 second and 0.33 v/μm (absolute value);
Third period E3: 1 second;
Second period E2: 0.2 second and 0.33 v/μm (absolute value).

Example 5

First, an electric field for a black display (0.2 second and 0.33 v/μm) was caused to act on each microcapsule of the display device, so that a black display state was achieved on the entire region of the display surface. Next, 1 second after achieving the black display state, a resetting electric field E was caused to act on each microcapsule in order to reset the black display state and achieve a white display state. Next, an electric field for a white display (0.2 second and 0.33 v/μm) was caused to act on each microcapsule. The strength and time of the resetting electric field are as follows:
First Period E1: 0.2 second and 0.33 v/μm (absolute value);
Third period E3: 2 seconds;
Second period E2: 0.2 second and 0.33 v/μm (absolute value).

Example 6

First, an electric field for a black display (0.2 second and 0.33 v/μm) was caused to act on each microcapsule of the display device, so that a black display state was achieved on the entire region of the display surface. Next, 1 second after achieving the black display state, a resetting electric field E was caused to act on each microcapsule in order to reset the black display state and achieve a white display state. Next, an electric field for a white display (0.2 second and 0.33 v/μm) was caused to act on each microcapsule. The strength and time of the resetting electric field are as follows:
First Period E1: 0.2 second and 0.33 v/μm (absolute value);
Third period E3: 3 seconds;
Second period E2: 0.2 second and 0.33 v/μm (absolute value).

Example 7

First, an electric field for a black display (0.2 second and 0.33 v/μm) was caused to act on each microcapsule of the display device, so that a black display state was achieved on the entire region of the display surface. The voltage application was repeated 6 times in total. Next, 1 second after achieving the black display state, a resetting electric field E was caused to act on each microcapsule in order to reset the black display state and achieve a white display state. Next, an electric field for a white display (0.2 second and 0.33 v/μm) was caused to act on each microcapsule. The strength and time of the resetting electric field are as follows:
First Period E1: 0.2 second and 0.33 v/μm (absolute value);
Third period E3: 1 second;
Second period E2: 0.2 second and 0.33 v/μm (absolute value).

Example 8

First, an electric field for a black display (0.2 second and 0.33 v/μm) was caused to act on each microcapsule of the display device, so that a black display state was achieved on the entire region of the display surface. Next, 1 minute after achieving the black display state, a resetting electric field E was caused to act on each microcapsule in order to reset the black display state and achieve a white display state. Next, an electric field for a white display (0.2 second and 0.33 v/μm) was caused to act on each microcapsule. The strength and time of the resetting electric field are as follows:
First Period E1: 0.2 second and 0.33 v/μm (absolute value);
Third period E3: 1 minute;
Second period E2: 0.2 second and 0.33 v/μm (absolute value).

Comparative Example 1

First, an electric field for a black display (0.2 second and 0.33 v/μm) was caused to act on each microcapsule of the display device, so that a black display state was achieved on the entire region of the display surface. Next, 1 second after achieving the black display state, an electric field for a white display (0.2 second and 0.33 v/μm) was caused to act on each microcapsule in order to switch the display state from the black display state to a white display state.

Comparative Example 2

First, an electric field for a black display (0.2 second and 0.33 v/μm) was caused to act on each microcapsule of the display device, so that a black display state was achieved on the entire region of the display surface. The voltage application was repeated 6 times in total. Next, 1 second after achieving the black display state, an electric field for a white display (0.2 second and 0.33 v/μm) was caused to act on each microcapsule in order to switch the display state from the black display state to a white display state.

Comparative Example 3

First, an electric field for a black display (0.2 second and 0.33 v/μm) was caused to act on each microcapsule of the display device, so that a black display state was achieved on the entire region of the display surface. Next, 1 minute after achieving the black display state, an electric field for a white display (0.2 second and 0.33 v/μm) was caused to act on each microcapsule in order to switch the display state from the black display state to a white display state.

3. Evaluation of Display Device

With respect to display switching drive of the display device in each Example and each Comparative Example, the reflectance of the display color of each display device was measured 3 seconds after the application of the electric field for a white display was completed. The reflectance of the display color of each display device represents the ratio of the reflection amount of the display color of each display device when the reflection amount of white color (standard sample) serving as a standard was adjusted to 100. The measurement of the reflectance amount was performed using a color luminance meter ("BM-5A", manufactured by TOPCON CORP.). The reflectance in each Example and each Comparative Example obtained as described above is shown in Table 1.

TABLE 1

| | Reflectance |
|---|---|
| Ex. 1 | 42% |
| Ex. 2 | 45% |
| Ex. 3 | 48% |
| Ex. 4 | 50% |
| Ex. 5 | 50% |
| Ex. 6 | 42% |
| Ex. 7 | 45% |
| Ex. 8 | 45% |
| Comp. Ex. 1 | 36% |
| Comp. Ex. 2 | 33% |
| Comp. Ex. 3 | 33% |

As is clear from Table 1, each Example has a high reflectance of 40% or more but, in contrast thereto, each Comparative Examples has a reflectance of only about 30% or so. More specifically, it was found that, in each Example, afterimages resulting from the black display state are prevented.

As a result of performing the same experiments as that of each Example and each Comparative Example were performed while changing the strength (absolute value) of the electric fields in the first period E1 and the second period E2 between 1 v/μm to 10 v/μm, the same results were obtained. Moreover, even when the white particles were not charged, the same results were obtained.

The entire disclosure of Japanese Patent Application No. 2010-141820, filed Jun. 22, 2010 is expressly incorporated by reference herein.

What is claimed is:

1. A method for driving a display sheet having a display layer having storage portions storing positively or negatively charged first particles and second particles that are charged with polarity opposite to that of the first particles and have color whose light reflectance is lower than that of the first particles, the method comprising:

displaying a desired image on the display surface provided at the one surface of the display layer by causing an electric field to act on the storage portions so that the storage portions achieves a first display state in which the second particles are unevenly present at one surface of the display layer and the first particles are dispersed in the storage portion or a second display state in which the second particles are unevenly present at the other surface of the display layer and the first particles are dispersed in the storage portion; and driving the display sheet in such a manner as to provide, when switching a first image displayed on the display surface to a second image different from the first image, a reset period for causing a resetting electric field for achieving the second display state to act at least on the storage portions in the first display state among the storage portions prior to causing an electric field for displaying the second image to act on the storage portions, the reset period having a first period in which the second particles are moved to the one surface and also the first particles are moved to the other surface and a second period, after the first period, in which the first particles are moved to the one surface and also the second particles are moved to the other surface.

2. The method for driving a display sheet according to claim 1, wherein the resetting electric field is caused to act only on the storage portion in the first display state.

3. The method for driving a display sheet according to claim 1, wherein the reset period has a third period in which no electric field is generated between the first period and the second period and the third period is within 2 seconds.

4. The method for driving a display sheet according to claim 1, wherein the first period is within 0.2 second or more.

5. The method for driving a display sheet according to claim 1, wherein the second period is within 0.2 second or more.

6. The method for driving a display sheet according to claim 1, wherein the strength of the resetting electric field in the first period is equal to the strength of the electric field that is caused to act on the storage portion when achieving the first display state in the storage portion.

7. The method for driving a display sheet according to claim 1, wherein the strength of the resetting electric field in the second period is equal to the strength of the electric field that is caused to act on the storage portion when achieving the second display state in the storage portion.

8. A display device, comprising a display sheet driven by the method according to claim 1.

9. An electronic device, comprising the display device according to claim 8.

10. A display sheet, comprising:

a display layer having storage portions storing positively or negatively charged first particles and second particles that are charged with polarity opposite to that of the first particles and have color whose light reflectance is lower than that of the first particles, by causing an electric field to act on each of the storage portions so that each of the storage portions achieves a first display state in which the second particles are unevenly present at one surface of the display layer and the first particles are dispersed in the storage portion or a second display state in which the second particles are unevenly present at the other surface of the display layer and the first particles are dispersed in the storage portion, the display sheet displaying a desired image on the display surface provided at the one surface of the display layer;

when switching a first image displayed on the display surface to a second image different from the first image, a reset period for causing a resetting electric field for achieving the second display state to act at least on the storage portions in the first display state among the storage portions being provided prior to causing an electric field for displaying the second image to act on the storage portions; and the reset period having a first period in which the second particles are moved to the one surface and also the first particles are moved to the other surface and a second period, after the first period, in which the first particles are moved to the one surface and also the second particles are moved to the other surface.

* * * * *